US007795824B2

(12) United States Patent
Shen et al.

(10) Patent No.: US 7,795,824 B2
(45) Date of Patent: Sep. 14, 2010

(54) LINEAR MOTOR AUTOMATIC CONTROL CIRCUIT ASSEMBLY FOR CONTROLLING THE OPERATION OF A 3-PHASE LINEAR MOTOR-DRIVEN SUBMERSIBLE OIL PUMP OF AN ARTIFICIAL OIL LIFT SYSTEM

(75) Inventors: Kuei-Hsien Shen, Hsichih (TW); Chinn-Chann Chiang, Hsichih (TW)

(73) Assignee: Digitek Technology Co., Ltd., Taipei County (TW)

( * ) Notice: Subject to any disclaimer, the term of this patent is extended or adjusted under 35 U.S.C. 154(b) by 385 days.

(21) Appl. No.: 12/073,073

(22) Filed: Feb. 29, 2008

(65) Prior Publication Data

US 2009/0218963 A1 Sep. 3, 2009

(51) Int. Cl.
*H02K 41/02* (2006.01)
*H02P 27/06* (2006.01)

(52) U.S. Cl. ..... 318/135; 318/481; 318/504

(58) Field of Classification Search ..... 318/135, 318/432, 479, 481, 482, 504, 621, 632, 687, 318/722, 800, 801
See application file for complete search history.

(56) References Cited

U.S. PATENT DOCUMENTS 5,222,867 A * 6/1993 Walker et al. ..... 417/12
2008/0031752 A1* 2/2008 Littwin et al. ..... 417/411

* cited by examiner

*Primary Examiner*—Bentsu Ro
(74) *Attorney, Agent, or Firm*—Rosenberg, Klein & Lee

(57) ABSTRACT

Connected to a 3-phase linear motor of a submersible oil pump of a crude oil production system, a linear motor automatic control circuit assembly is disclosed to include a linear motor power supply circuit, a CPU, an insulated gate bipolar transistor driving circuit, a current detection circuit, a temperature sensor, a fluid depth sensor, a function setting and status display circuit, and a circuit assembly power supply circuit for controlling the operation speed of the linear motor subject to the submergence depth of the linear motor in the oil well.

6 Claims, 6 Drawing Sheets

LINEAR MOTOR AUTOMATIC CONTROL CIRCUIT ASSEMBLY FOR CONTROLLING THE OPERATION OF A 3-PHASE LINEAR MOTOR-DRIVEN SUBMERSIBLE OIL PUMP OF AN ARTIFICIAL OIL LIFT SYSTEM

BACKGROUND OF THE INVENTION

1. Field of the Invention

The present invention relates to an artificial oil lift system and more specifically, to a linear motor automatic control circuit assembly for controlling the operation of a 3-phase linear motor-driven submersible oil pump of an artificial oil lift system.

2. Description of the Related Art

Beam/sucker-rod pumping is the most popular artificial lift in oil well for the production of crude oil today. A beam/sucker-rod pumping system has a submersible oil pump set in the oil well, and a rotary motor mounted on the ground to cause the walking beam to pivot up and down. The walking beam causes the sucker rod string attached to opposite end of the walking beam to rise and fall. This activates the submersible oil pump which lifts the oil up to the ground surface. The speed of the submersible oil pump that is installed in an oil well is adjustable by the worker at the ground. Further, the depth of the oil level in an oil well may change subject to the geological structure and the status of flowing of fluid into the oil well. Conventionally, the control of pump speed of a submersible oil pump in an oil well is done subject to the submergence depth of the submersible oil pump, and the measurement of the depth of the oil level is done externally with a independent acoustic echo device. When adjusting the pump speed of a submersible oil pump in an oil well, the whole artificial lift system must be stopped. Further, the adjustment of the pump speed is complicated and limited to discrete stroke number adjustment. A continuous pump speed adjustment is not workable.

U.S. Pat. No. 731,627 discloses an oil pumping unit using a submersible oil pump driven by a synchronizing three-phase linear motor. According to this design, the oil pumping unit uses a synchronizing linear motor to reciprocate a pump, causing the pump to lift the oil from the oil well to the ground continuously during the down stroke as well as during the up stroke.

SUMMARY OF THE INVENTION

It is one object of the present invention to provide a liner motor automatic control assembly for artificial oil lift system, which controls the operation speed of the linear motor of the artificial oil lift system subject to the submergence depth of the linear motor in the oil well.

To achieve this and other objects of the present invention, the linear motor automatic control circuit assembly is connected to a 3-phase linear motor of a submersible oil pump of an artificial oil lift system, comprising a linear motor power supply circuit, a CPU, an insulated gate bipolar transistor driving circuit, a current detection circuit, a fluid depth sensor, a function setting and status display circuit, and a circuit assembly power supply circuit, the linear motor power supply circuit being comprised of a 3-phase rectifier, a charging resistor, a filter and three insulated gate bipolar transistors and adapted to provide power supply to the linear motor, the insulated gate bipolar transistor driving circuit being electrically connected between the CPU and the insulated gate bipolar transistors of the linear motor power supply circuit and adapted for controlling on, off and speed of the linear motor, the current detection circuit being electrically connected between the CPU and current transformers at a front side of the linear motor power supply circuit and adapted for detecting the current value at the linear motor and providing the detected current value to the CPU for overcurrent protection control, the fluid depth sensor being electrically connected to the CPU and adapted for detecting the depth of the oil level in the oil well and providing the detected value to the CPU for reference in controlling the operation of the linear motor, the function setting and status display circuit being electrically connected to the CPU for setting system function parameters and displaying the settings and the status of the operation of the system, the circuit assembly power supply circuit providing the linear motor automatic control circuit assembly with the necessary working voltage.

DETAILED DESCRIPTION OF THE PREFERRED EMBODIMENT

Figure 1:
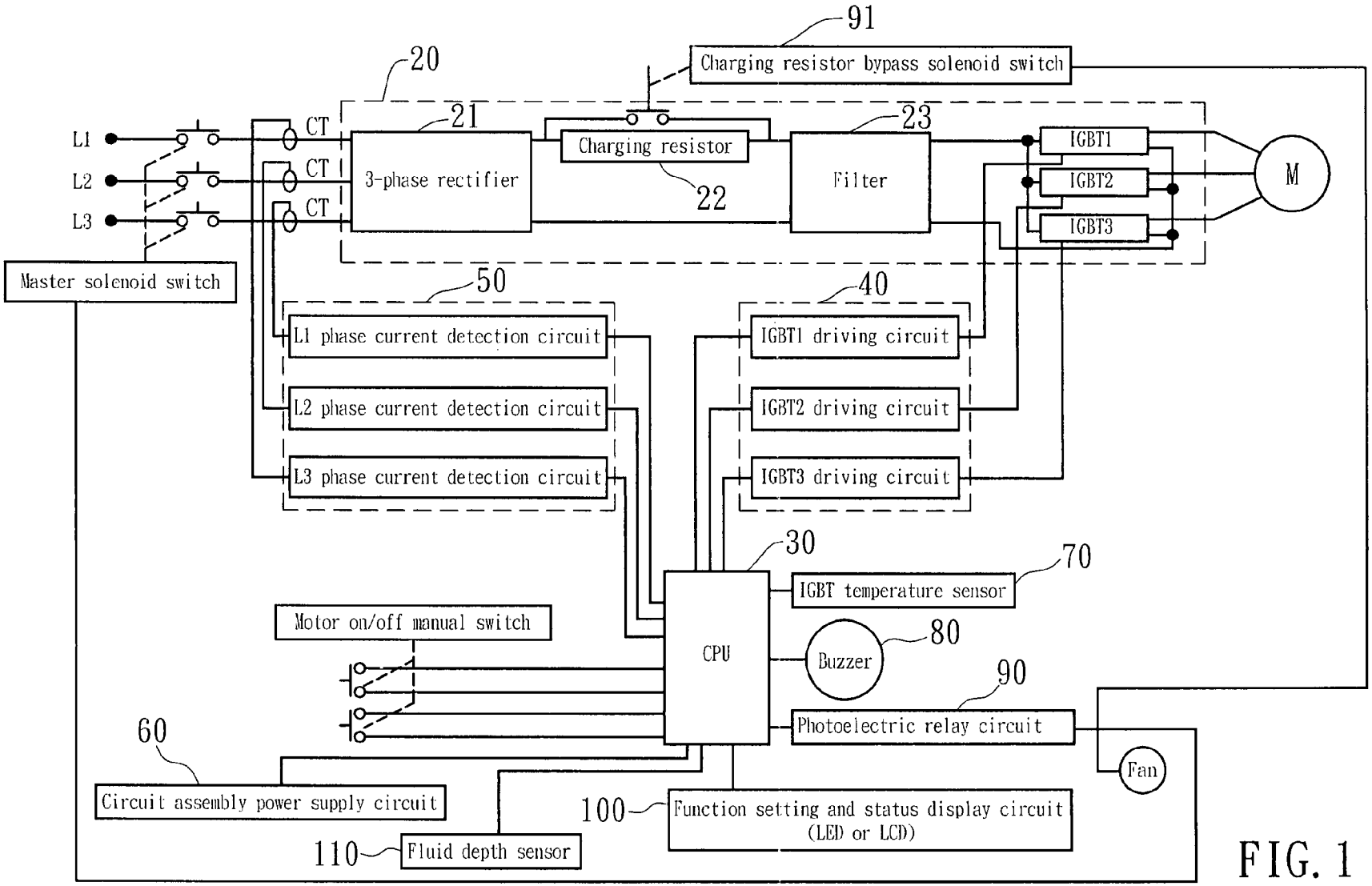
FIG. 1 is a circuit block diagram of a linear motor automatic control circuit assembly according to the present invention.
Figure 2:
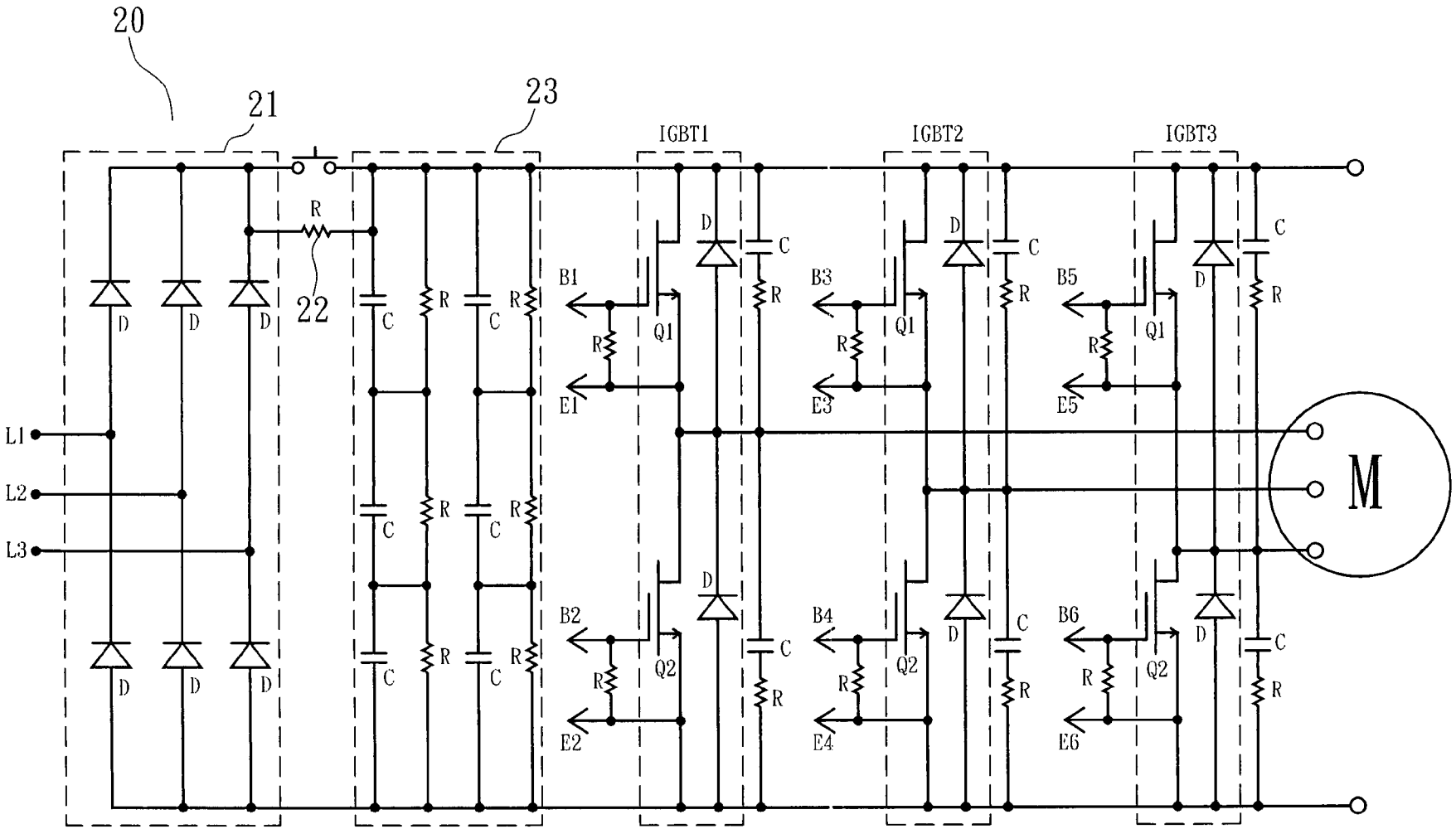
FIG. 2 is a circuit diagram of the linear motor power supply circuit of the linear motor automatic control circuit assembly according to the present invention.
Figure 3:
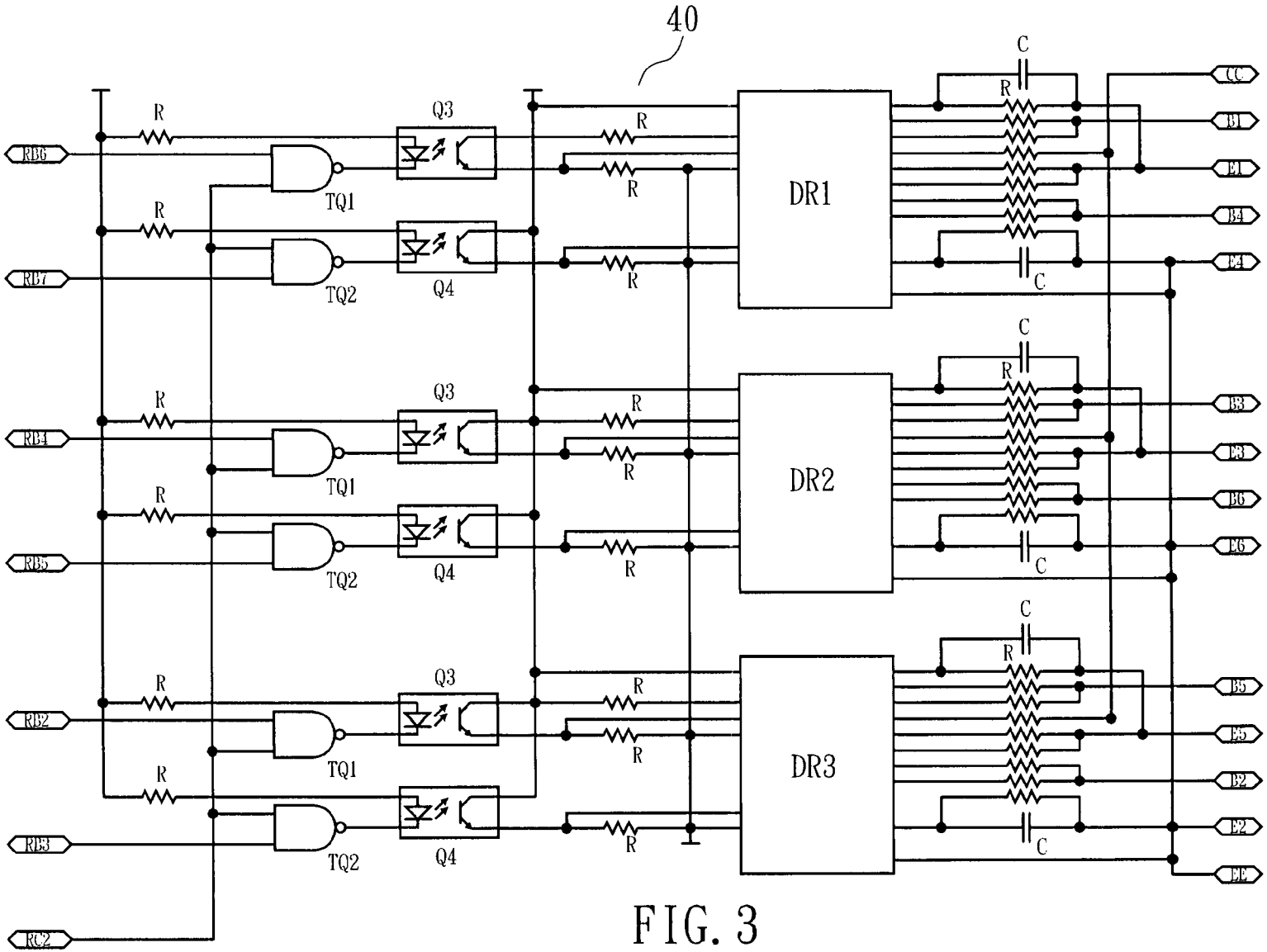
FIG. 3 is a circuit diagram of the insulated gate bipolar transistor driving circuit of the linear motor automatic control circuit assembly according to the present invention.
Figure 4:
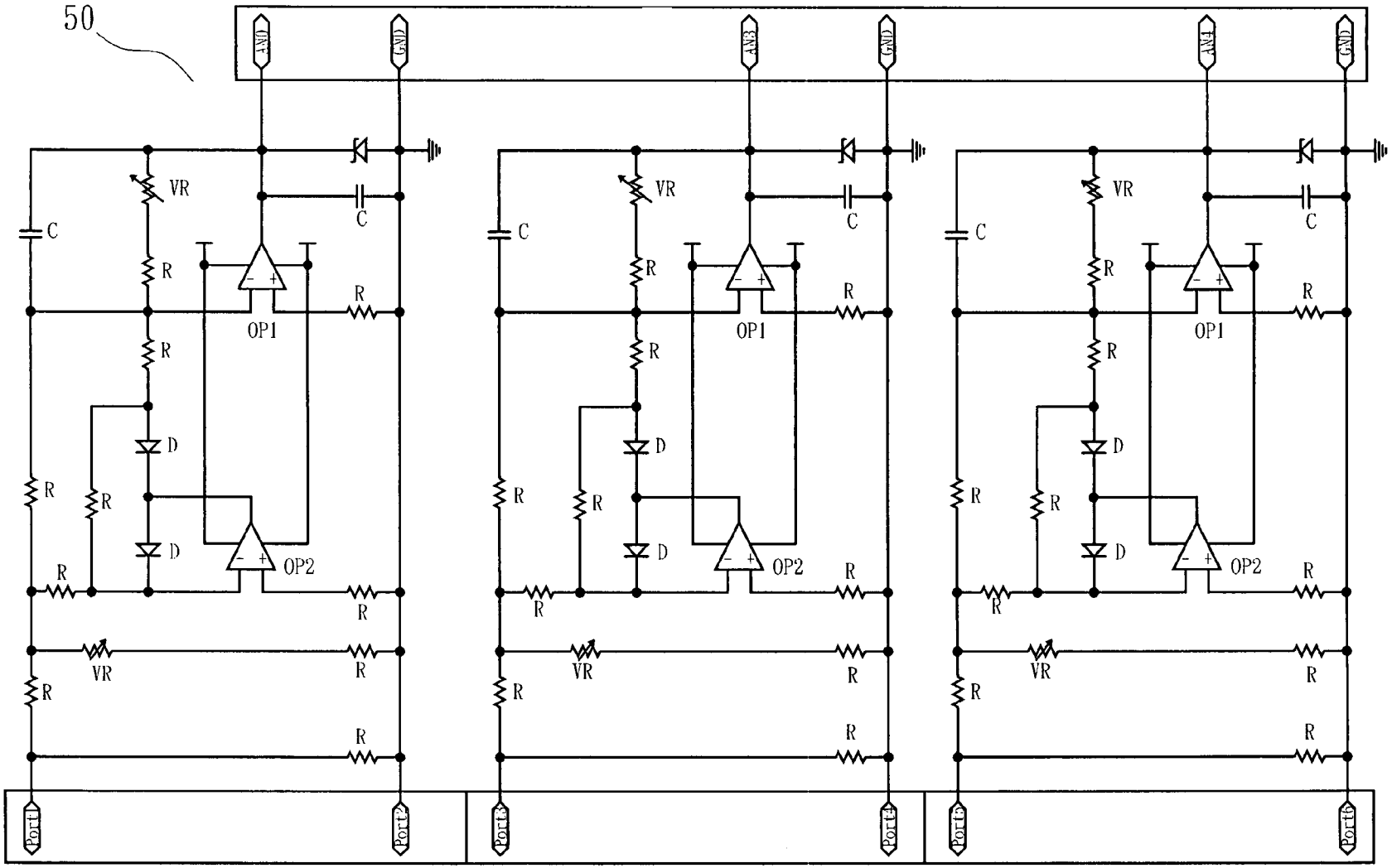
FIG. 4 is a circuit diagram of the current detection circuit of the linear motor automatic control circuit assembly according to the present invention.
Figure 5:
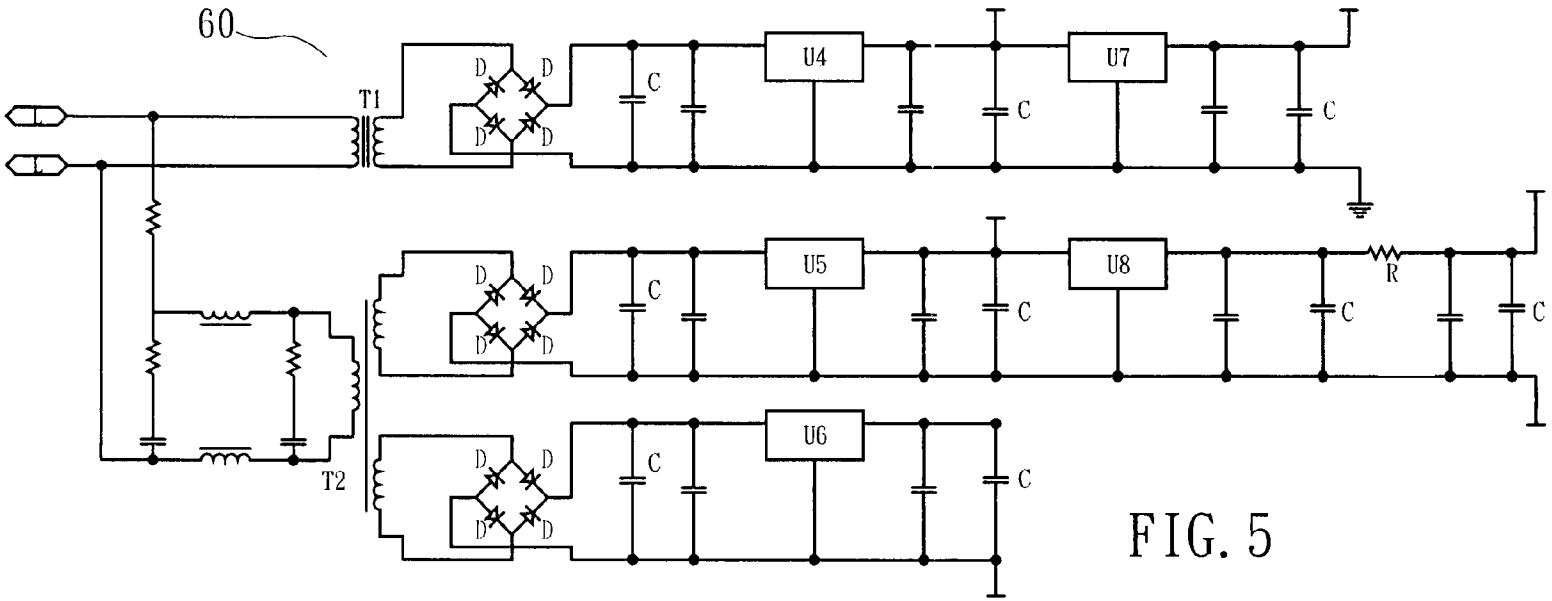
FIG. 5 is a circuit diagram of the circuit assembly power supply circuit of the linear motor automatic control circuit assembly according to the present invention.
Figure 6:
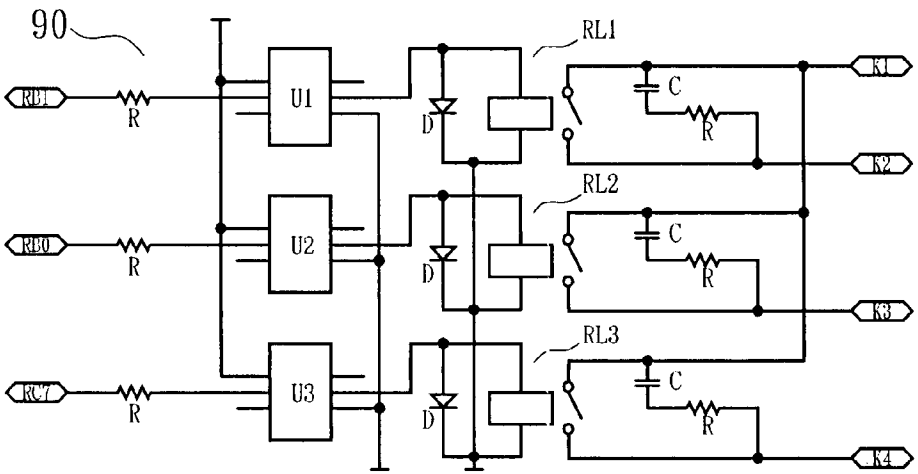
FIG. 6 is a circuit diagram of the photoelectric relay circuit of the linear motor automatic control circuit assembly according to the present invention.
Figure 8:
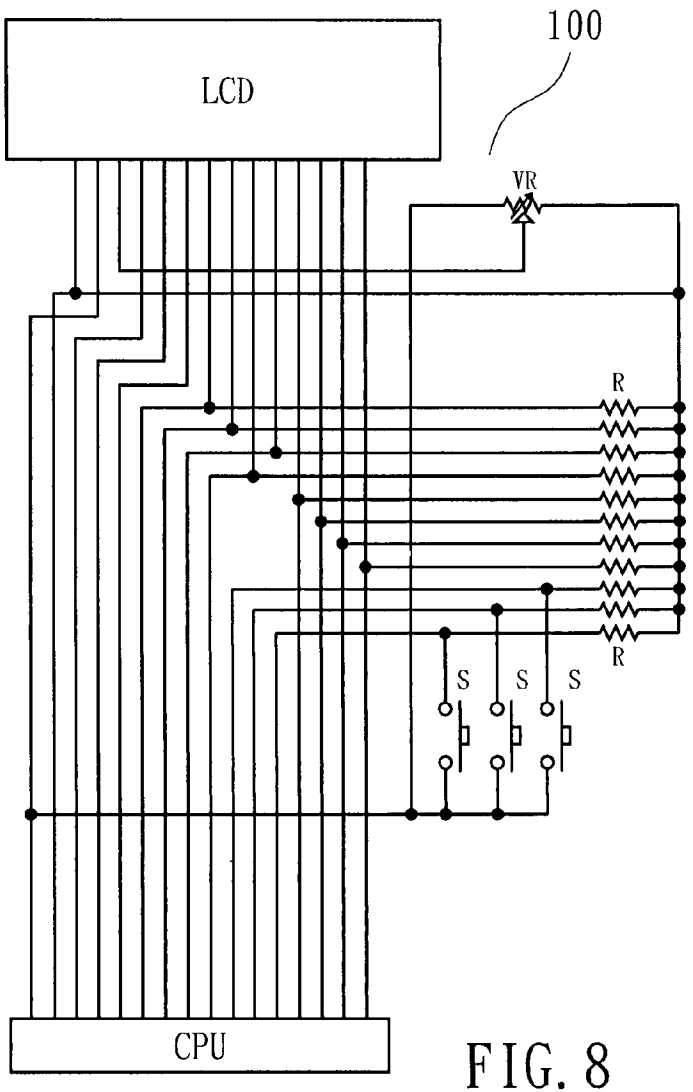
FIG. 8 is a circuit diagram of an alternate form of the function setting and status display circuit of the linear motor automatic control circuit assembly according to the present invention.
Figure 7:
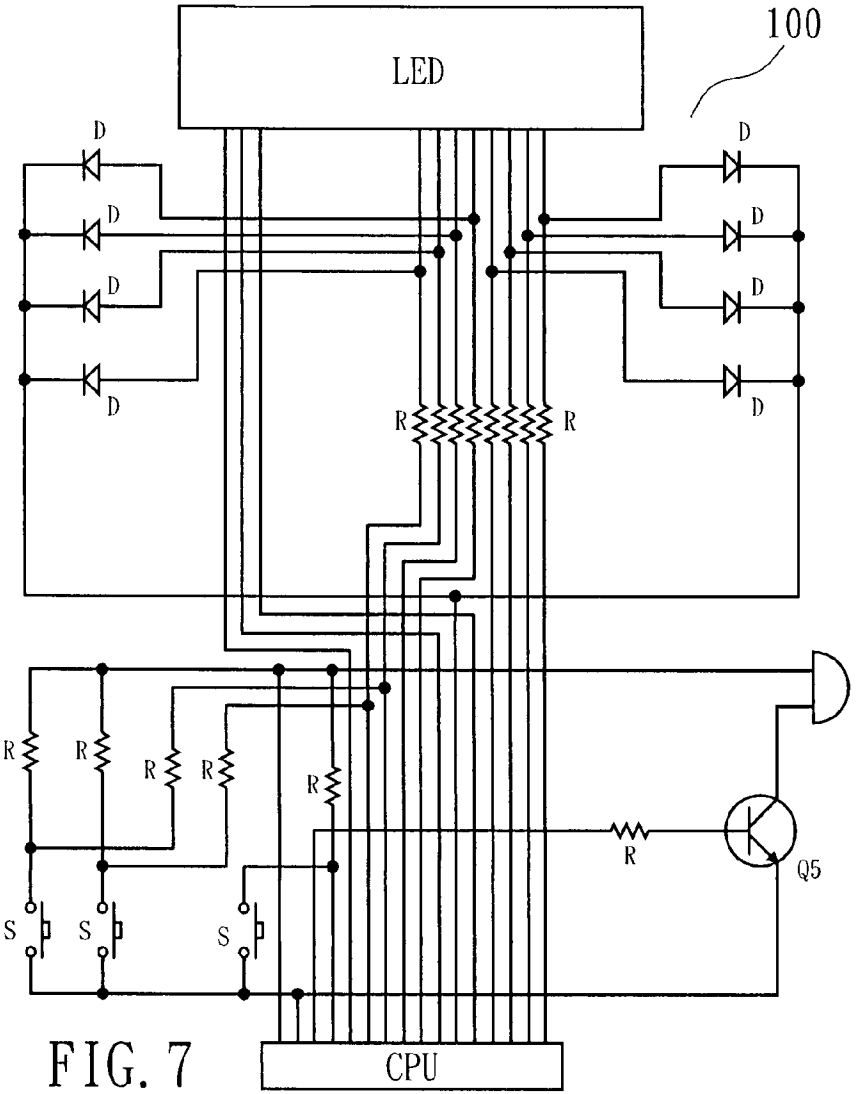
FIG. 7 is a circuit diagram of the function setting and status display circuit of the linear motor automatic control circuit assembly according to the present invention.

Referring to FIGS. 1~8, a linear motor automatic control circuit assembly is connected to a 3-phase linear motor M that is adapted to drive a submersible oil pump of an artificial oil lift system. The linear motor automatic control circuit assembly comprises a linear motor power supply circuit 20, a CPU 30, an insulated gate bipolar transistor driving circuit 40, a current detection circuit 50, a fluid depth sensor 110, a function setting and status display circuit 100, and a circuit assembly power supply circuit 60. The linear motor power supply circuit 20 is comprised of a 3-phase rectifier 21, a charging resistor 22, a filter 23 and insulated gate bipolar transistors IGBT1, IGBT2 and IGBT3, and adapted to provide power supply to the linear motor M. The insulated gate bipolar transistor driving circuit 40 is electrically connected between the CPU 30 and the insulated gate bipolar transistors IGBT1, IGBT2 and IGBT3 of the linear motor power supply circuit 20, and adapted to control on, off and speed of the linear motor M. The current detection circuit 50 is electrically connected between the CPU 30 and the current transformers CT at the front side of the linear motor power supply circuit 20, and adapted to detect the current value at the linear motor M and to provide the detected current value to the CPU 30 for overcurrent protection control. The fluid depth sensor 110 is electrically connected to the CPU 30, and adapted to detect the depth of the oil level in the oil well and to provide the detected value to the CPU 30 for reference in controlling the operation of the linear motor M. The function setting and status display circuit 100 is electrically connected to the CPU 30 for setting system function parameters and displaying the settings and the status of the operation of the system. The circuit assembly power supply circuit 60 provides the whole system of the circuit assembly with the necessary working voltage. The linear motor automatic control circuit assembly further comprises a temperature sensor 70, a buzzer 80, and a photoelectric relay circuit 90. The photoelectric relay circuit 90 has one end electrically connected to the CPU 30, and the other end electrically connected to a cooling fan, a charging resistor bypass solenoid switch and a master solenoid switch. The temperature sensor 70 detects the temperature of the insulated gate bipolar transistors insulated gate bipolar transistors IGBT1, IGBT2 and IGBT3 of the linear motor power supply circuit 20. When the temperature of the insulated gate bipolar transistors insulated gate bipolar transistors IGBT1, IGBT2 and IGBT3 of the linear motor power supply circuit 20 surpassed a predetermined value, the CPU 30 drives the respective relay to turn on the cooling fan. If the operation of the cooling fan still cannot lower the temperature of the insulated gate bipolar transistors insulated gate bipolar transistors, the CPU 30 drives the respective relay to switch off the master solenoid switch, thereby stopping the linear motor M and simultaneously turn on the buzzer 80 to produce an alarm sound. The charging resistor bypass solenoid switch 91 is controlled by a charging resistor bypass control relay of the photoelectric relay circuit 90. When the power of the linear motor M is on, the CPU 30 drives the charging resistor bypass control relay of the photoelectric relay circuit 90 to switch off the charging resistor bypass switch, causing the output current of the rectifier to go through the charging resistor 22 into the filter 23, thereby lowering the charging speed of the capacitor of the filter 23. When the capacitor of the filter 23 is charged over 60%, the CPU 30 drives the charging resistor bypass control relay of the photoelectric relay circuit 90 to switch on the charging resistor bypass switch, causing the rectifier output DC to go directly to the filter 23 without going through the charging resistor 22. When the rectifier output DC is going through the charging resistor, the CPU 30 does not start the insulated gate bipolar transistor driving circuit 40, and therefore the linear motor M is off during charging of the capacitor of the filter 23 through the charging resistor.

In one example of the present invention as shown in FIG. 2 again, the linear motor power supply circuit 20 comprises a 3-phase rectifier 21 formed of multiple diodes D, a charging resistor 22, a filter 23 formed of a number of resistors R and capacitors C, and three insulated gate bipolar transistors IGBT1, IGBT2 and IGBT3. Each insulated gate bipolar transistor is comprised of two switching transistors Q1 and Q2, and a plurality of resistors R, capacitors C and diodes D. The 3-phase rectifier 21 rectifies 3-phase AC into DC. The three insulated gate bipolar transistors IGBT1, IGBT2 and IGBT3 control on and off of the linear motor M. When the power source is on, the charging resistor 22 lowers the charging speed of the capacitor of the filter 23. When the capacitor of the filter 23 is charged over 60%, the output DC of the 3-phase rectifier 21 goes through the bypass to the filter 23 directly without going through the charging resistor 22.

In one example of the present invention as shown in FIG. 3 again, the insulated gate bipolar transistor driving circuit 40 is comprised of three sets of flip flops TQ1, TQ2, photocoupling transistors Q3, Q4, insulated gate bipolar transistor drivers DR1, DR2, DR3, resistors R and capacitors C. The insulated gate bipolar transistor driving circuit 40 is electrically connected to the 3-phase insulated gate bipolar transistors IGBT1, IGBT2, IGBT3 of the linear motor M to control on/off of the insulated gate bipolar transistors and to further control on, off and operation speed of the linear motor M.

In one example of the present invention as shown in FIG. 4 again, the current detection circuit 50 is comprised of three operation amplifiers OP1, OP2, a plurality of resistors R, capacitors C and variable resistors VR. The current detection circuit 50 is electrically connected to the current transformers CT at the front side of the linear motor power supply circuit 20 to detect the current value at the linear motor M and to provide the detected current value to the CPU 30 for overcurrent protection control.

In one example of the present invention as shown in FIG. 5 again, the circuit assembly power supply circuit 60 is comprised of transformers T1, T2, three bridge rectifiers each formed of two diodes D, and voltage stabilizing transistors U4, U5, U6, U7, U8. The circuit assembly power supply circuit 60 provides the whole circuit system of the circuit assembly with the necessary DC working voltage.

In one example of the present invention as shown in FIG. 6 again, the photoelectric relay circuit 90 is comprised of three phototransistors U1, U2, U3, relays RL1, RL2, RL3, diodes D, resistors R and capacitors C, and adapted to control the operation of the cooling fan, the charging resistor bypass solenoid switch and the master solenoid switch.

In one example of the present invention as shown in FIG. 7 again, the function setting and status display circuit 100 is comprised of LED indicator lights, resistors R, diodes D, key pad S and transistors Q5. The key pad S is provided for inputting the desired settings. The LED indicator lights are controllable to indicate system operation status.

In one example of the present invention as shown in FIG. 8 again, the function setting and status display circuit 100 is comprised of a LCD screen, resistors R, key pad S and variable resistors VR. The key pad S is provided for inputting the desired settings. The LCD screen is adapted to display system operation status.

Further, the linear motor M is coupled to the top side of the submersible oil pump. During vertical reciprocation of the linear motor M, the submersible oil pump is moved to pump crude oil. The CPU 30 outputs a control signal to the insulated gate bipolar transistor driving circuit 40 to turn on the insulated gate bipolar transistors IGBT1, IGBT2, IGBT3, thereby causing the linear motor M to move the submersible oil pump. During operation of the linear motor M, the current detection circuit 50 monitors the current value at the linear motor M, the temperature sensor 70 monitors the temperature of the insulated gate bipolar transistors, and the fluid depth sensor 110 monitors the depth of the oil level in the oil well.

The fluid depth sensor 110 outputs the detected value to the CPU 30 for enabling the CPU 30 to measure the submergence depth of the linear motor in the crude oil in the oil well so that the CPU 30 controls the operation speed of the linear motor subject to the measured result, keeping the crude oil production rate in balance with the pumping flow rate of the oil pump and preventing damage of the linear motor. If the submergence depth of the linear motor is smaller than the predetermined lower limit level, the CPU 30 immediately stops the operation of the linear motor and will start the linear motor again when the submergence depth of the linear motor surpasses the predetermined lower limit level.

The current detection circuit 50 monitors the current value at the linear motor M, and outputs the detected result to the CPU 30. When the current at the linear motor M surpassed a predetermined level, the CPU 30 starts the overload protection function to stop the linear motor M and to turn on the buzzer 80, causing the buzzer 80 to output an audio alarm signal.

When the temperature of the insulated gate bipolar transistors IGBT1, IGBT2, IGBT3 surpassed a predetermined value, the temperature sensor 70 immediately sends a signal to the CPU 30, causing the CPU 30 to start the cooling fan. If the temperature of the insulated gate bipolar transistors IGBT1, IGBT2, IGBT3 does not drop below the predetermined value after a predetermined length of time during the operation of the cooling fan, the CPU 30 immediately switches off the master solenoid switch, thereby turning off the linear motor M and driving the buzzer 80 to output an audio alarm signal.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A linear motor automatic control circuit assembly connected to a 3-phase linear motor that is adapted for driving a submersible oil pump of a crude oil production system to pump crude oil out of an oil well, said linear motor automatic control circuit assembly comprising a linear motor power supply circuit, a CPU, an insulated gate bipolar transistor driving circuit, a current detection circuit, a fluid depth sensor, a function setting and status display circuit, and a circuit assembly power supply circuit, said linear motor power supply circuit being comprised of a 3-phase rectifier, a charging resistor, a filter and three insulated gate bipolar transistors and adapted to provide power supply to said linear motor, said insulated gate bipolar transistor driving circuit being electrically connected between said CPU and said insulated gate bipolar transistors of said linear motor power supply circuit and adapted for controlling on, off and speed of said linear motor, said current detection circuit being electrically connected between said CPU and current transformers at a front side of said linear motor power supply circuit and adapted for detecting the current value at said linear motor and providing the detected current value to said CPU for overcurrent protection control, said fluid depth sensor being electrically connected to said CPU and adapted for detecting the depth of the oil level in said oil well and providing the detected value to said CPU for reference in controlling the operation of said linear motor, said function setting and status display circuit being electrically connected to said CPU for setting system function parameters and displaying the settings and the status of the operation of the system, said circuit assembly power supply circuit providing the linear motor automatic control circuit assembly with the necessary working voltage.

2. The linear motor automatic control circuit assembly as claimed in claim 1, wherein said linear motor power supply circuit comprises a 3-phase rectifier formed of multiple diodes, a charging resistor, a filter formed of a number of resistors and capacitors, and three insulated gate bipolar transistors, each said insulated gate bipolar transistor being comprised of two switching transistors, and a plurality of resistors, capacitors and diodes, said 3-phase rectifier rectifying 3-phase AC into DC, said three insulated gate bipolar transistors controlling on, off and speed of said linear motor.

3. The linear motor automatic control circuit assembly as claimed in claim 1, wherein said insulated gate bipolar transistor driving circuit is comprised of three sets of flip flops, a plurality of photocoupling transistors, insulated gate bipolar transistor drivers, resistors and capacitors, said insulated gate bipolar transistor driving circuit being electrically connected to said 3-phase insulated gate bipolar transistors of said linear motor to control on/off of said insulated gate bipolar transistors and to further control on, off and operation speed of said linear motor.

4. The linear motor automatic control circuit assembly as claimed in claim 1, wherein said current detection circuit is comprised of three operation amplifiers, a plurality of resistors, capacitors and variable resistors, said current detection circuit being electrically connected to current transformers at a front side of said linear motor power supply circuit to detect the current value at said linear motor and to provide the detected current value to said CPU for overcurrent protection control.

5. The linear motor automatic control circuit assembly as claimed in claim 1, wherein said circuit assembly power supply circuit is comprised of transformers, three bridge rectifiers each formed of two diodes, and voltage stabilizing transistors, said circuit assembly power supply circuit providing the linear motor automatic control circuit assembly with the necessary DC working voltage.

6. The linear motor automatic control circuit assembly as claimed in claim 1, further comprising a temperature sensor, a buzzer, and a photoelectric relay circuit, said photoelectric relay circuit having one electrically connected to said CPU and an opposite end electrically connected to a cooling fan, a charging resistor bypass solenoid switch and a master solenoid switch, said master solenoid switch being controllable by said CPU to turn off said linear motor.

* * * * *